United States Patent [19]

Lin

[11] Patent Number: 4,752,023

[45] Date of Patent: Jun. 21, 1988

[54] TAPE DISPENSER

[76] Inventor: Juchen Lin, No. 195, Wen-Shin Rd., Sec. 3, Taichung, Taiwan

[21] Appl. No.: 1,046

[22] Filed: Jan. 7, 1987

[51] Int. Cl.[4] ..... B26F 3/02

[52] U.S. Cl. ..... 225/26; 225/80; 225/90

[58] Field of Search ..... 225/21, 25, 26, 77, 225/80, 90

[56] References Cited

U.S. PATENT DOCUMENTS

| | | | |
|---|---|---|---|
| 2,553,658 | 5/1951 | Larson | 225/25 |
| 3,102,670 | 9/1963 | Krueger | 225/90 |
| 3,265,264 | 8/1966 | Stephens | 225/25 |
| 3,273,772 | 9/1966 | Nakajima et al. | 225/77 |

*Primary Examiner*—E. R. Kazenske
*Assistant Examiner*—Hien H. Phan
*Attorney, Agent, or Firm*—Holman & Stern

[57] ABSTRACT

An improved tape dispenser comprises a body in the form of a rectangular block with a recess at one end to contain a wheel with a tape reel thereon, a tape stand with a zigzag cutter blade at the other end, a first adhesion face behind the cutter blade, a side post with a guide roller in the middle of the body to depress the tape passing beneath it, and another tape stand with a second adhesion face so that the tape extending from the tape reel is bent in a plurality of positions to maintain stability of the body, prevent the wheel from being pulled out of the body and prevent dislocation of the uncut end of the tape from the first adhesion face by reaction of the reel after cutting.

2 Claims, 2 Drawing Sheets

TAPE DISPENSER

BACKGROUND OF THE INVENTION

1. Field of the Invention

The present invention relates to an improvement in a tape dispenser, particularly such a dispenser for tape wound in a reel.

2. Description of the Prior Art

Conventionally a tape dispenser is mainly composed of, as shown in FIG. 1, a body 11, a wheel 12 for holding a tape reel 13 at one end of the body 11, and a stand 14 with a zigzag cutter blade 15 having an adhesion face 16 behind it at the other end the body. In using of such a tape dispenser, tape 131 is extended from the tape reel 13 to the desired length and the tape 131 is pressed downward for cutting by the cutter blade 15 as shown in FIG. 5.

However, in using such a dispenser, it has been found that the adhesion face 16 extending from the cutter blade 15 directly is for positioning of the tip of the tape after cutting, and the tape 131 so positioned is usually declined, and the tip is not always properly adhered to the adhesion face 16. Furthermore, release of pulling force usually makes the wheel 12 and tape reel 13 unbalanced and turn reversely, whereby the tip is separated from the adhesion face 16, and then adheres to other places such as on the tape reel itself and thus, further use of the tape becomes inconvenient, particularly during winter while adhesion of tape is usually weak. There has been an improvement by widening the adhesion face 16, but the widening causes difficulty in taking out the tip from the adhesion face 16 and fingers must be put at a certain distance away from the tip for taking out the same, and consequently the tape adheres to the finger or is twisted itself.

SUMMARY OF THE INVENTION

The main objective of the present invention is to provide an improved tape dispenser structure to eliminate the aforesaid defects by providing a roller between the tape reel and cutter blade to guide and depress the tape passing beneath it and by providing one adhesion face at a certain distance away from the cutter blade and between the latter and the roller to position the tape in order to prevent dislocation of the tape.

Another objective of the present invention is to provide an improved tape dispenser structure which has a space for a finger to hold the tape as close to its tip as possible and to make extending of the tape stable.

The improved tape dispenser according to the present invention is therefore characterized by a narrow adhesion face extended behind the cutter blade, a wide adhesion face between the narrow adhesion face and the tape reel, and a roller between the wide adhesion face and the tape reel to depress the tape is adhere firmly to the wide adhesion face so that the tape is bending on several positions to assure stability of the tape during extending and cutting.

The improved tape cutter according to the present invention is further characterized by the height of the roller which is lower than that of the cutter blade or the wide adhesion face in order to compress the tape downward to adhere to the wide adhesion face and to prevent from dislocation of the tape reel when pulling force is released.

The improved tape cutter according to the present invention is further characterized by the narrow adhesion face extended behind the cutter blade and a U-like space between these adhesion faces for insertion of finger to take the tape at a position as close to its tip as possible.

BRIEF DESCRIPTION OF THE DRAWINGS

The invention will now be described in detail with reference to the accompanying drawings wherein.

DETAILED DESCRIPTION OF THE PREFERRED EMBODIMENT

Figure 2:
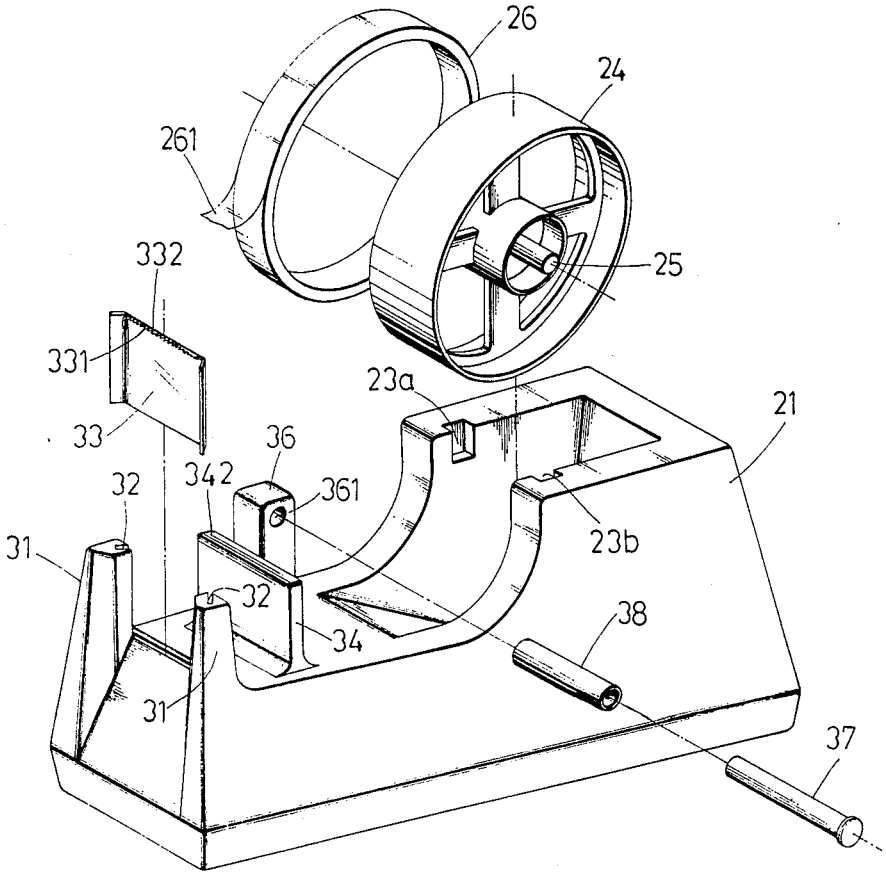
FIG. 2 is an exploded perspective view of a preferred embodiment of an improved tape dispenser according to the present invention.
Figure 3:
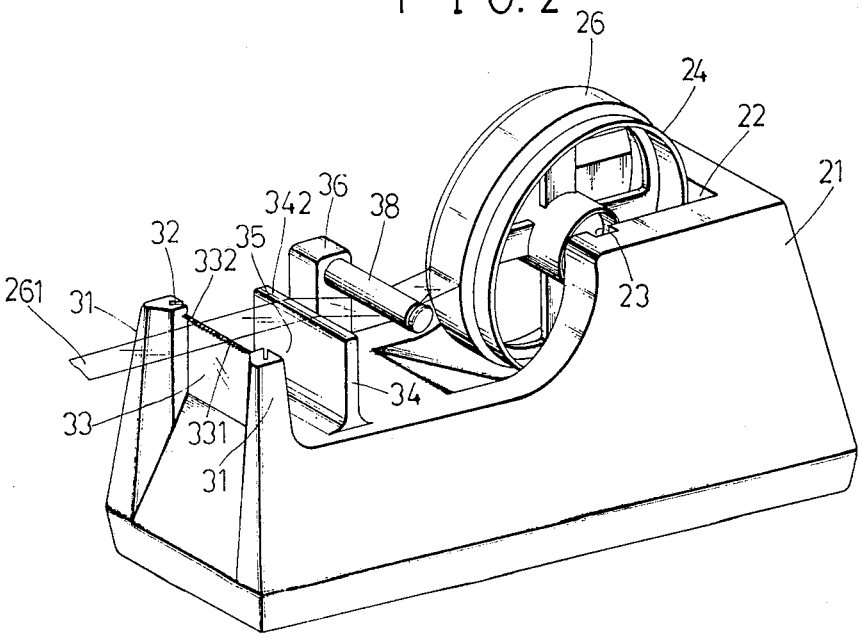
FIG. 3 is a perspective view illustrating the tape dispenser shown in FIG. 2 assembled.

As shown in FIGS. 2 and 3, the tape dispenser according to the present invention comprises a body 21 made of plastic material in the form of a hollow rectangular block filled with material of high specific gravity to improve its stability. The body 21 has a recess 22 at one end. A slot **23*a* is made on one side of the recess 22 and another slot 23*b* symmetrically on the opposite side. It further comprises a wheel 24 with axle shaft pins or ends 25 which are removably located in slots 23*a*, 23*b*; a tape reel 26 placed over the wheel 24; two symmetrical stands 31 each with a vertical installation slot 32 at another end of the body 21, and a zigzag cutter blade 33 installed in the installation slots 32. A small planar face 332 is extended behind the edge 331 of the cutter blade 33 as the first adhesion face. Another vertical stand 34 is placed between the cutter blade 33 and the tape reel 26, and has a top surface used as the second adhesion face 342. There is a U-like space between the first stands 31 and the second stand 34. A side post 36 is provided with a hole 361 for installation of a shaft rod 37 between the second stand 34 and the tape wheel 24, and a roller 38 is installed on the shaft rod 37**.

According to the invention, the shaft pins 25, roller 38, the second stand 34 and the cutter blade 33 are parallel to each other, and the bottom of the roller 38 is on a level lower than the height of the first and second adhesion faces 332 and 342.

Instead of the first adhesion face 332 extending from the edge 331 of the cutter blade 33, it is possible that a further metal plate may be added behind the cutter blade on the first stands 31 with its top surface as an auxiliary adhesion face.

Figure 4:
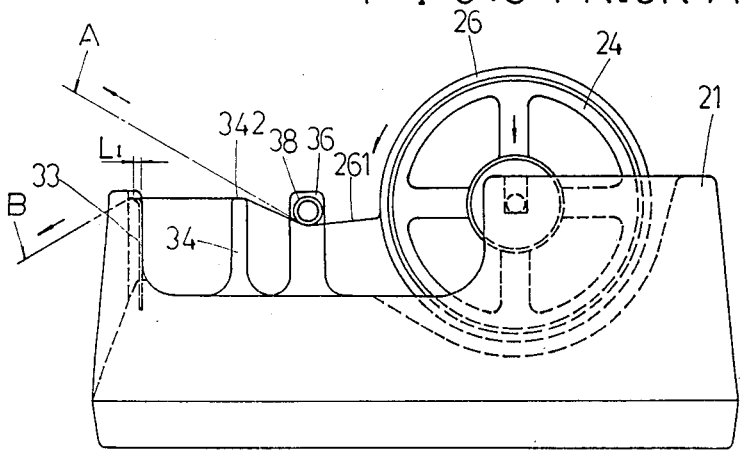
FIG. 4 is a side elevational view which illustrates using the tape dispenser shown in FIG. 2.

For use of the improved tape dispenser according to the present invention, please refer to FIG. 4.

The tape 261 extends from the tape reel 26 with its back keeping contact with the bottom of the roller 38. Extension of the tape is shown by the line A in FIG. 4. Pulling of the tape causes the tape reel 26 to turn downwardly smoothly at the side of the roller and helps the body 21 to maintain its stability.

Cutting of the tape 261 is produced by pulling in the direction of line B in FIG. 4. The tape 261 bends in a plurality of positions, among them one is by depression by roller 38 so that the tape 261 adheres to the second adhesion face 342 before it is cut by the cutter blade 33.

Therefore, while the tape 261 is being cut, it is firmly adhered to the second adhesion face 342 and it will not be dislocated by reaction of the tape reel 26, but the tip of the tape 261 is still adhered to the first adhesion face 332 so that it is easy to make the next extension and cutting of the tape.

The present invention has two adhesion faces 332 and 342. The second adhesion face 342 is for positioning and thus is wider than the first adhesion face which is narrower than the conventional one. Therefore, for taking of the tape, the user has to extend his finger into the U-like space between cutter blade 33 and stand 34. This design allows the user to take the tape 261 as close to the tip of the tape as possible to make taking of the tape 261 easy and to avoid adhesion to the finger. L1 in FIG. 4 represents the length of the tip of the tape 261 after taking by the finger.

Figure 1:
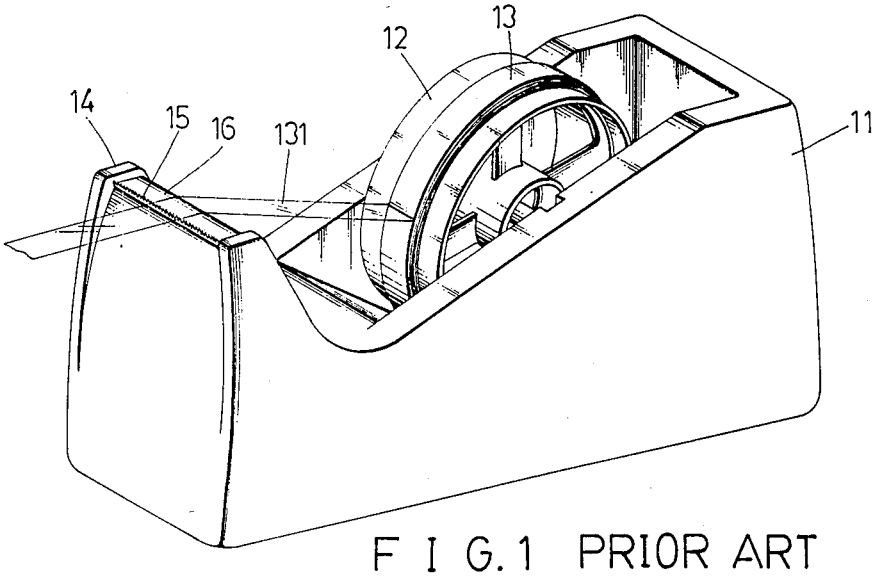
F I G. 1 PRIOR ART
FIG. 1 is a perspective view of a conventional tape dispenser.
Figure 5:
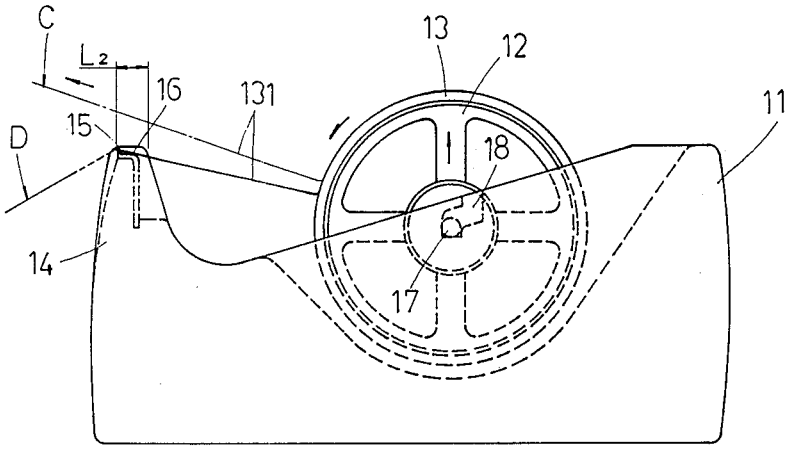
F I G. 5 PRIOR ART
FIG. 5 is a view similar to FIG. 4 which illustrates using the conventional tape dispenser shown in FIG. 1.

As a comparison, use of the conventional tape dispenser is illustrated in FIG. 5. Extension of the tape 131 is shown by the line C. In pulling it, the tape 131 tends to move upwards. Therefore, the slots 18 for holding of shaft pins 17 must be curved or bent to prevent dislocation of the tape reel 13, and the body 11 during pulling is thus less stable. Cutting of the tape 131 is made by pulling in the direction of line D, the tape 131 is declined and when its tip is cut by the cutter blade 15, it is adhered to the adhesion face 16 in a declined position, and thus it is not firmly adhered thereto so that reaction of the tape reel 13 will loosen it, and at each taking of the tape 131 a tip with a length of at least equal to that represented by L2 in the drawing will be exposed outside the user's finger, and the tape may be twisted. In other words, the improved tape dispenser structure according to the present invention is much more effective and convenient than the conventional structure as shown by the comparison between FIGS. 4 and 5.

What is claimed is:

1. In a tape dispenser for one-sided adhesive tape wherein the nonadhesive side faces upwardly having a body with a tape holder end and a cutting end, a recess in the tape holder end for receiving at least part of a tape wheel and having two opposite sides, two symmetrical slots in the sides, a tape wheel in the form of a disc for holding a tape reel at least partly within the recess, axle shaft means at the center of the tape wheel having ends removably located in the slots so that the tape wheel is rotatably mounted in the recess, a first stand extending upwardly from the cutting end, a cutter blade having an upper cutting edge mounted on the first stand, a first adhesion face extending from the cutter blade toward the tape holder end of the body, a second stand extending upwardly from the body between the cutter blade and tape wheel, a top surface on the second stand functioning as a second adhesion face, and a guide roller mounted on the body between the tape wheel and the cutter blade extending parallel to the cutter blade, the improvement comprising:

the two symmetrical slots being vertical;

the first stand being a pair of spaced symmetrical stands extending upwardly adjacent opposite sides of the body;

two symmetrical vertical cutter blade slots in said air of spaced symmetrical stands, the cutter blade having side edges and being mounted on said pair of stands by engagement of said side edges in said cutter blade slots;

the second stand being a vertical planar stand having a substantially constant thickness equal to the width of the second adhesion face and being spaced from said pair of symmetrical stands to provide a U-shaped opening for inserting a finger of a user;

the second adhesion face being substantially the same height as the first adhesion face;

a side post extending upwardly from one side of the body only between said planar stand and the tape wheel;

a guide roller shaft member having one end fixedly mounted on said side post and having a central axis extending parallel to the cutter; and a guide roller rotatably mounted concentrically on said guide roller shaft and having an outer cylindrical tape-engaging surface the bottom of which is lower than the second adhesion face and the upper surface of the tape wheel and is engageable with the upper surface of the tape so that the tape is depressed downwardly by said roller between the tape wheel and the second adhesion face.

2. An improvement in a tape dispenser as claimed in claim 1 wherein:

the width of said second adhesion face is greater than the width of the first adhesion face.

* * * * *